US006695180B2

(12) United States Patent
Rohrer et al.

(10) Patent No.: US 6,695,180 B2
(45) Date of Patent: Feb. 24, 2004

(54) LIFTING AND CLOSING DEVICE FOR A BEVERAGE BOTTLE

(75) Inventors: Martin Rohrer, Allenwinden (CH); Roy Schaerer, Grezenbach (CH)

(73) Assignee: RMD Engineering AG, Unterageri (CH)

( * ) Notice: Subject to any disclaimer, the term of this patent is extended or adjusted under 35 U.S.C. 154(b) by 288 days.

(21) Appl. No.: 09/955,848

(22) Filed: Sep. 18, 2001

(65) Prior Publication Data

US 2002/0033400 A1 Mar. 21, 2002

(30) Foreign Application Priority Data

Sep. 19, 2000 (EP) ..... 00810852

(51) Int. Cl.[7] ..... B65D 83/00

(52) U.S. Cl. ..... 222/469; 222/471; 222/511; 251/7

(58) Field of Search ..... 222/464.1, 469, 222/471, 509, 511; 251/7

(56) References Cited

U.S. PATENT DOCUMENTS

| | | | |
|---|---|---|---|
| 5,169,016 | A | 12/1992 | Hinz, Jr. |
| 5,588,565 | A | 12/1996 | Miller |

FOREIGN PATENT DOCUMENTS

| | | | |
|---|---|---|---|
| BE | 503 765 | A | 6/1951 |
| DE | 876 980 | C | 5/1953 |

*Primary Examiner*—Philippe Derakshani
(74) *Attorney, Agent, or Firm*—McCormick, Paulding & Huber LLP

(57) ABSTRACT

A lifting and closing device for a beverage bottle comprises a stopper made of elastic material, a clamping mechanism which clamps the stopper closed in the neutral position, a handle, and a trigger integrated into the handle for actuating the clamping mechanism for the temporary opening of the stopper.

16 Claims, 3 Drawing Sheets

LIFTING AND CLOSING DEVICE FOR A BEVERAGE BOTTLE

CROSS REFERENCE TO RELATED APPLICATIONS

Figure 1:
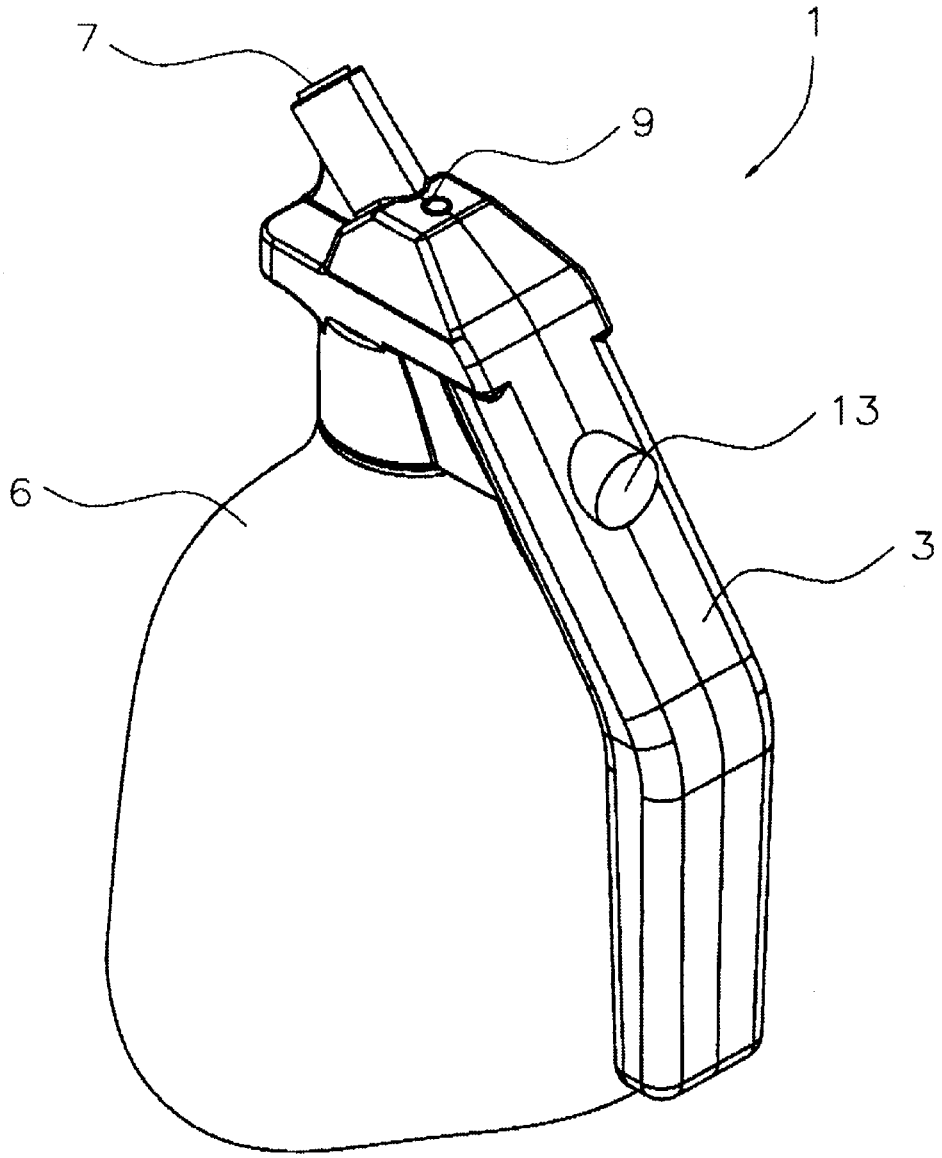

This application claims priority from and incorporates by reference the subject matter of European Patent Application 00810852.4 filed Sep. 19, 2000.

FIELD OF THE INVENTION

The invention concerns a lifting and closing device for a beverage bottle.

Such lifting and closing devices permit repeated opening and closing of beverage bottles with ease.

SUMMARY OF THE INVENTION

Several devices are known with which, after initial opening, beverage bottles can again be temporarily closed. There are products with which bottles can be clamped and lifted with a part similar to a handle. In addition, covers for beverage bottles are known which however do not allow simultaneous use.

The object of the invention is to develop a lifting and closing device for a beverage bottle which enables a pleasant lifting, guiding and use of the bottle.

BRIEF DESCRIPTION OF THE INVENTION

The lifting and closing device for beverage bottles in accordance with the invention comprises a stopper made of elastic material, a clamping mechanism for automatically clamping the stopper closed, a handle, and a trigger integrated into the handle for actuating the clamping mechanism for temporary opening of the stopper. Preferably, the clamping mechanism has two clamp jaws moveable relative to one another the opening and closing movement of which is coupled with the movement of the trigger so that actuating the trigger leads to a movement of the clamp jaws running orthogonal to its direction of movement. Optionally, a cover is foreseen so that the bottle is no longer directly visible.

In the following, an embodiment of the invention is explained in more detail based on the drawing.

BRIEF DESCRIPTION OF THE DRAWING FIGURES

Figure 2:
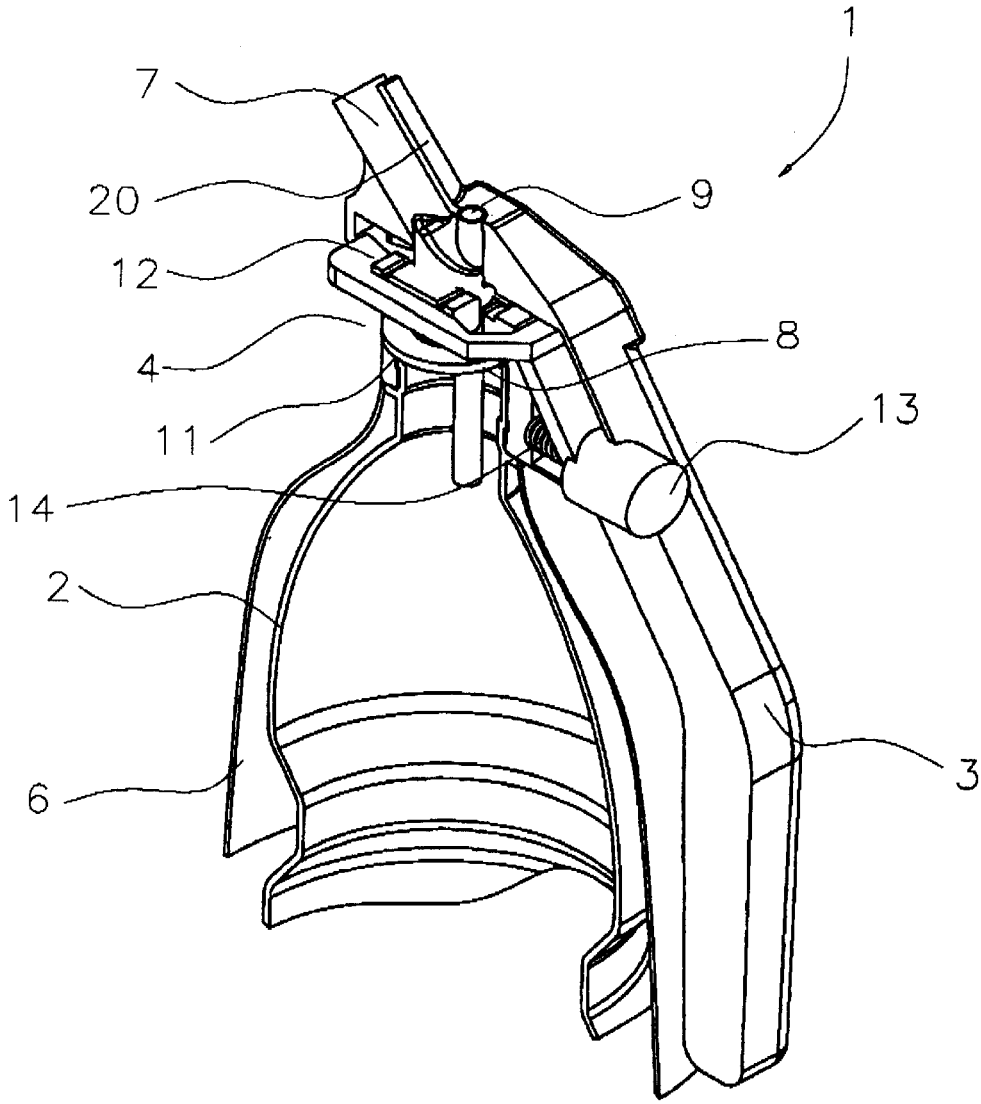
Figure 3:
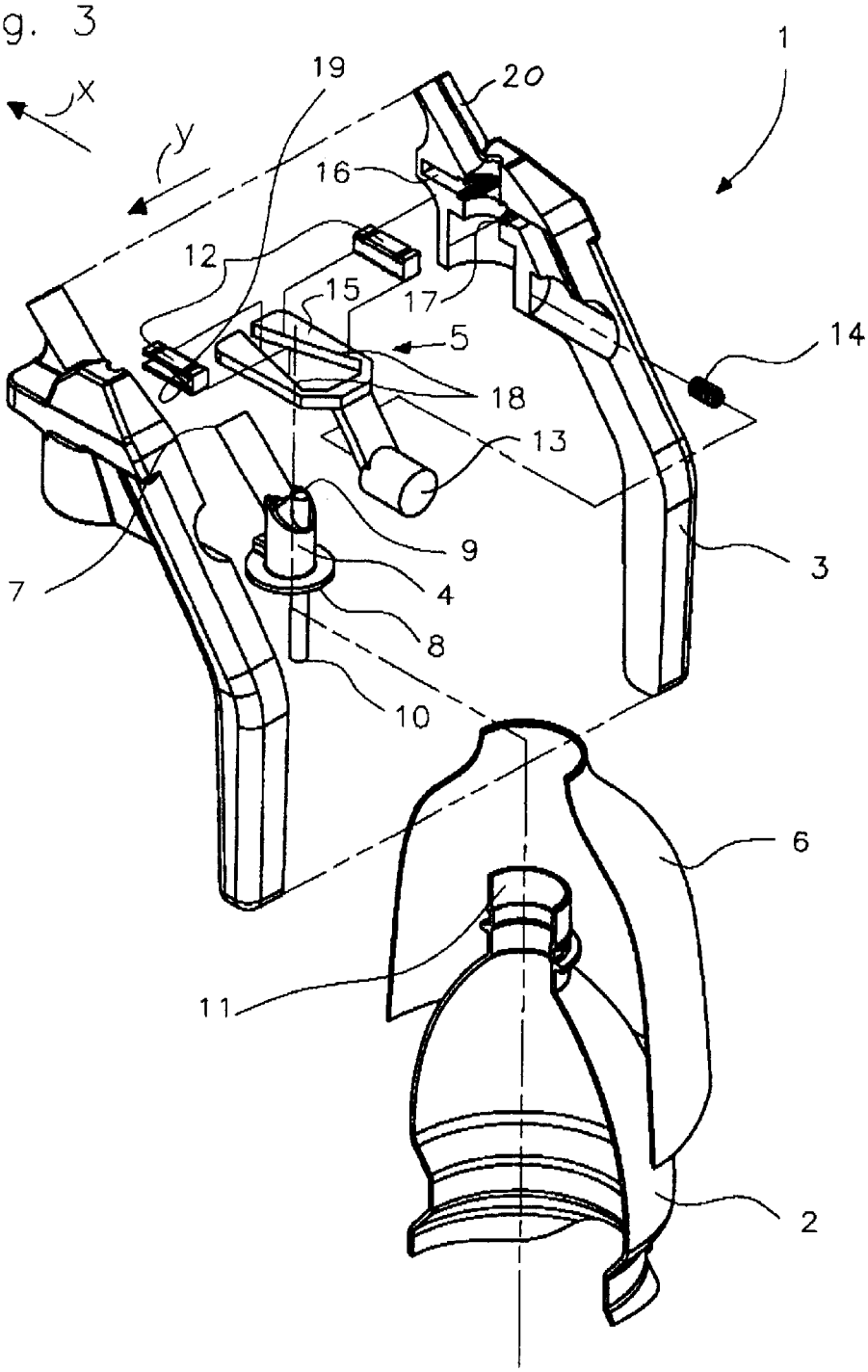

It is shown in:

FIG. 1 a perspective presentation of a lifting and closing device,

FIG. 2 a cutaway of the lifting and closing device along the line I—I in FIG. 1, FIG. 3 an exploded view in an isometric sectional presentation of the lifting and closing device.

DETAILED DESCRIPTION OF THE INVENTION

FIGS. 1–3 show various presentations of a lifting and closing device 1 which sits on top of a beverage bottle 2. With the presentation in FIG. 3, all the essential parts of the invention are visible individually; For reasons of illustrative clarity, they are drawn partly offset in relation to their actual position, whereby appropriate lines indicate their correct location. In addition, here the handle is cut away in the centre.

The lifting and closing device 1 comprises a handle 3, a stopper 4 made of elastic material such as rubber for example, a clamping mechanism for automatically clamping the stopper 4 closed, a trigger mechanism 5 integrated into the handle 3 for the temporary opening of the stopper 4, as well as optionally a cover 6 for covering the beverage bottle 2. The stopper 4, preferably manufactured as one piece, has a spout 7, a sealing lip 8, a suction part 9 and a tube 10. The sealing lip 8 seals the spout 11 of the beverage bottle 2. The clamping mechanism consists of two clamp jaws 12 which clamp the stopper 4 from opposite sides. The trigger mechanism 5 comprises a trigger 13 integrated into the handle 3 actuated manually with the thumbs in a direction designated as x direction which, in the neutral position, is pushed towards the outside by a spring 14 and which has a u-shaped end with two opposing jaws 15. The handle 3 has a groove 16 for accepting and guiding the jaw 15 of the trigger 13 in the x direction and a groove 17 for accepting and guiding the clamp jaws 12 in a y direction orthogonal to the x direction. The clamp jaws 12 are pushed onto the two jaws 15. The jaws 15 have inside surfaces 18 facing each other which run inclined to one another. The clamp jaws 12 contain a surface 19 running obliquely to their direction of movement which, in operation, rests on the inner surface 18 of the corresponding jaw 15 so that the surface 19 slides on the inner surface 18.

In the neutral position, the two clamp jaws 12 squeeze together the stopper 4 and the suction part 9 so that the beverage bottle 2 is airtight. To pour out liquid, the trigger 13 is pressed towards the inside in x direction against the force of the spring 14. In doing so, the jaws 15 are also shifted in x direction. The clamp jaws 12 cannot make this movement: They slide on the surface 19 of the corresponding jaw 15 whereby the distance between the inner surfaces 18 of the two jaws 15 which determines the position of the clamp jaws 12 increases. Because of the internal stress of the elastically deformed stopper 4, the clamp jaws 12 are pressed apart. In this way, the movement of the jaws 15 in x direction is converted into a movement of both clamp jaws 12 in the y direction orthogonal to it. Liquid can now be poured out. When pouring out liquid, a vacuum is created in the beverage bottle 2. By means of the suction part 9, air is drawn in and led through the tube 10 into the beverage bottle 2. In this way the liquid flows out uniformly over the spout 7. When the trigger 13 is released, the spring 14 pushes the trigger 13 outwards again into the neutral position. In doing so, the distance between the inner surfaces 18 of the jaws 15 is reduced so far that the clamp jaws 12 squeeze the stopper 4 again.

The lifting and closing device 1 has a tube 20 which accepts and supports the spout 7 of the stopper 4.

The lifting and closing device 1 can, for example, be manufactured in that the parts presented in FIG. 3 including the handle 3 which comprises two parts are firstly constructed individually and then joined together, whereby the two parts of the handle 3 are finally connected as detachable or non-detachable either by gluing, screwing, welding, etc.

If, for any reason, too great an overpressure is created in the beverage bottle 2, then the clamp jaws 12 are automatically pressed apart so that the gas causing the overpressure in the beverage bottle 2 can escape through the tube 10. The spring constant of the spring 14 as well as any friction losses in the trigger mechanism determine the degree of the overpressure with which the stopper automatically opens. Because in addition all moving parts are arranged in the inside of the lifting and closing device, protection from flying parts is guaranteed, even with bursting of the closing mechanism. Furthermore, all components are manufactured from non-splintering material. The liquid only comes into contact with the stopper 4.

If present, the cover 6 is arranged on the lifting and closing device 1. It covers the beverage bottle 2 partly or completely. It can be designed as a decorative cover and/or as a cover carrying advertising.

For cleaning, it suffices to rinse out the lifting and closing device 1 with hot water or to wash it in the dishwasher.

The fixing of the lifting and closing device on the beverage bottle 2 takes place for example by means of screwing for which purpose a corresponding thread is foreseen in the lifting and closing device. The fixing can however also take place by pressing on whereby the lifting and closing device engages with the spout 7 of the beverage bottle 2.

The lifting and closing device is suitable for all types of bottle, for example for bottles made of PET or glass.

Instead of the trigger mechanism 5 described with which the movement of the trigger 13 is converted into a movement of the clamp jaws 12 oriented obliquely to it, it is also possible to foresee a trigger mechanism 5 with which the movement of the trigger 13 is converted into a rotating movement, for example, as with scissors pre-tensioned with a spring.

While embodiments and applications of this invention have been shown and described, it would be apparent to those skilled in the art having the benefit of this disclosure that many more modifications than mentioned above are possible without departing from the inventive concepts herein. The invention, therefore, is not to be restricted except in the spirit of the appended claims and their equivalents.

What is claimed is:

1. Lifting and closing device for a beverage bottle, comprising:

a stopper made of elastic material, a clamping device which clamps the stopper closed in a neutral position, a handle, and a trigger integrated into the handle for actuating the clamping mechanism for temporary opening of the stopper.

2. Lifting and closing device according to claim 1 wherein the clamping mechanism has two clamp jaws moveable relative to each other, wherein the trigger has two opposing jaws each of which accepts a clamp jaw and has a surface working together with the clamp jaw which runs obliquely to the direction of movement of the trigger so that the movement of the trigger leads to a movement of the clamp jaws running orthogonal to its direction of movement.

3. Lifting and closing device according to claim 1 wherein the trigger is pre-tensioned by means of a spring.

4. Lifting and closing device according to claim 2 wherein the trigger is pre-tensioned by means of a spring.

5. Lifting and closing device according to claim 1 wherein the stopper is made of rubber.

6. Lifting and closing device according to claim 2 wherein the stopper is made of rubber.

7. Lifting and closing device according to claim 3 wherein the stopper is made of rubber.

8. Lifting and closing device according to claim 4 wherein the stopper is made of rubber.

9. Lifting and closing device according to claim 1 further comprising a cover for covering the beverage bottle.

10. Lifting and closing device according to claim 2 further comprising a cover for covering the beverage bottle.

11. Lifting and closing device according to claim 3 further comprising a cover for covering the beverage bottle.

12. Lifting and closing device according to claim 4 further comprising a cover for covering the beverage bottle.

13. Lifting and closing device according to claim 5 further comprising a cover for covering the beverage bottle.

14. Lifting and closing device according to claim 6 further comprising a cover for covering the beverage bottle.

15. Lifting and closing device according to claim 7 further comprising a cover for covering the beverage bottle.

16. Lifting and closing device according to claim 8 further comprising a cover for covering the beverage bottle.

* * * * *